US007125003B1

(12) United States Patent
Falkner

(10) Patent No.: US 7,125,003 B1
(45) Date of Patent: Oct. 24, 2006

(54) LIQUID TREATMENT INJECTOR

(76) Inventor: Kemp E Falkner, 3888 N. Ponce De Leon, St. Augustine, FL (US) 32084

( * ) Notice: Subject to any disclaimer, the term of this patent is extended or adjusted under 35 U.S.C. 154(b) by 222 days.

(21) Appl. No.: 10/785,231

(22) Filed: Feb. 25, 2004

(51) Int. Cl.
*B01F 3/04* (2006.01)

(52) U.S. Cl. ..... 261/76; 261/DIG. 75; 137/599.12; 210/220

(58) Field of Classification Search ..... 261/76, 261/DIG. 75; 417/186, 192; 137/599.12, 137/601.2, 894; 210/195.2, 220, 321.69, 210/130, 136
See application file for complete search history.

(56) References Cited

U.S. PATENT DOCUMENTS

| | | | | |
|---|---|---|---|---|
| 2,746,250 A | | 5/1956 | Hawkins | 60/51 |
| 2,873,758 A | * | 2/1959 | Nielsen | 137/211 |
| 2,953,160 A | * | 9/1960 | Brazier | 137/599.12 |
| 3,204,459 A | | 9/1965 | Lehrer | 73/213 |
| 3,460,805 A | | 8/1969 | Kudlaty | 251/357 |
| 3,820,556 A | * | 6/1974 | Millar et al | 137/220 |
| 4,885,084 A | | 12/1989 | Doyle | 210/132 |
| 5,073,310 A | | 12/1991 | Ramsey | 261/76 |
| 5,694,966 A | | 12/1997 | Holder | 137/115.11 |
| 2002/0163089 A1 | * | 11/2002 | La Crosse | 261/76 |

* cited by examiner

*Primary Examiner*—Matthew O. Savage
(74) *Attorney, Agent, or Firm*—Charles M. Kaplan

(57) ABSTRACT

A reagent injector and/or aerator for aqueous fluids can use a variety of different removable end caps to adapt a venturi to different types of water treatment systems. The invention is adjustable because the end caps can be removed and springs that activate poppet valves can be changed to accommodate changes in the pressure or flow requirements of the system in which it is used. In addition to, or instead of, atmospheric air, reagent chemical solutions or gasses can be entrained into a flowing water stream by the venturi.

23 Claims, 10 Drawing Sheets

LIQUID TREATMENT INJECTOR

BACKGROUND OF THE INVENTION

This invention relates to the treatment of liquids, and more particularly to the aeration of potable water to enhance its treatment and/or to facilitate the storage of fully treated potable water.

OBJECTIVES OF THE INVENTION

Accordingly, it is an object of this invention to provide improved reactant injecting aeration devices for aqueous solutions.

Another object is to provide injector aerators that can be adjusted when system operating conditions change.

An additional object is to provide removable flow directing or controlling end caps for a venturi housing that has separated internal flow channels.

Another object is to integrate into a single fitting for a water treatment system, a back pressure relief valve, a check valve, a system pressure relief valve and a venturi aerator.

Another object is to provide venturi aerator housings that can be used in different water treatment systems by attaching different end caps to the housings.

A further object is to provide an aerator with removable valve positioner capsules.

An additional object is to provide potable water aerators that are usable under widely varying operating conditions.

Another object is to provide venturi injectors for air or chemical solutions in systems that recycle reverse osmosis concentrate back into the stream of water being treated.

A further object is to provide reactant injector venturi aerators for potable water treatment systems that are durable, economical, easy to use and repair and adjust and maintain, and which do not possess defects found in similar prior art aerators.

Other objects and advantages of the reactant injectors and aerators incorporating this invention will be found in the specification and claims and the scope of the invention will be set forth in the claims.

DESCRIPTION OF THE INVENTION

Figure 1:
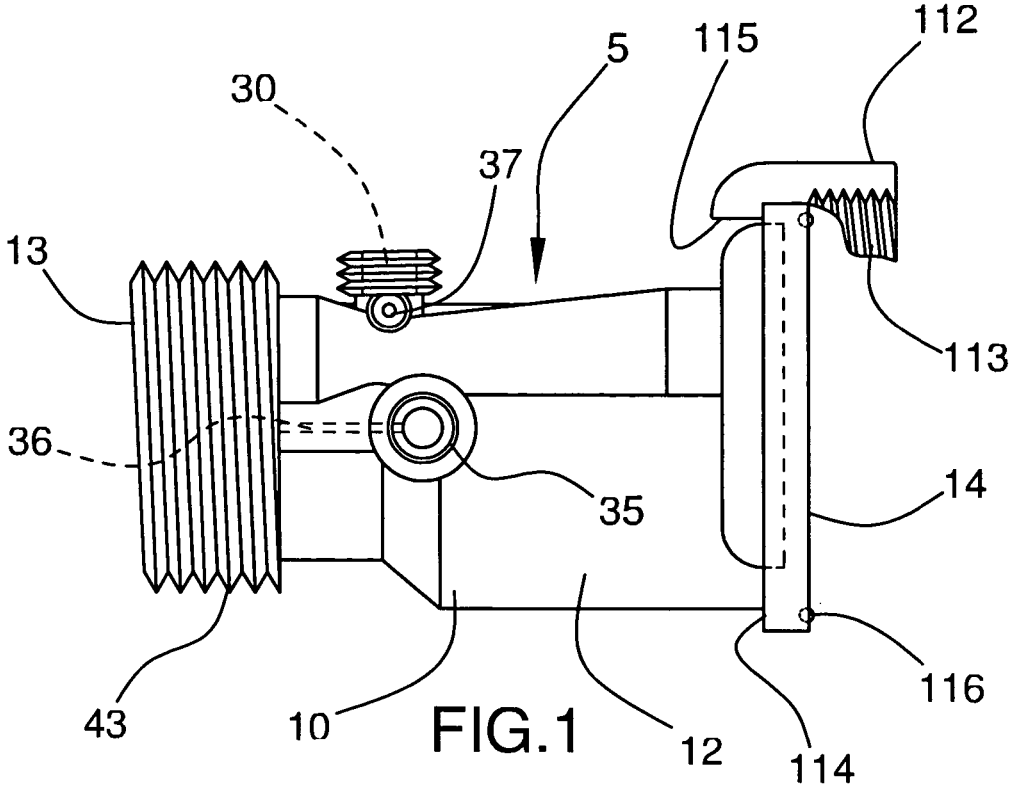
FIG. 1 is a partially broken away, side view of an embodiment of an air inductor in accord with this invention.
Figure 2:
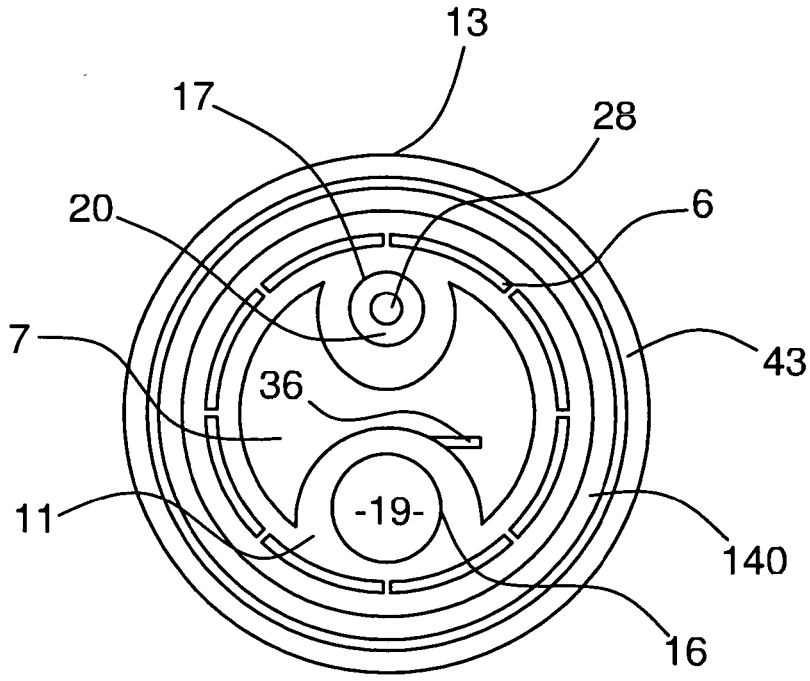
FIG. 2 is an end view of the inductor in FIG. 1.
Figure 3:
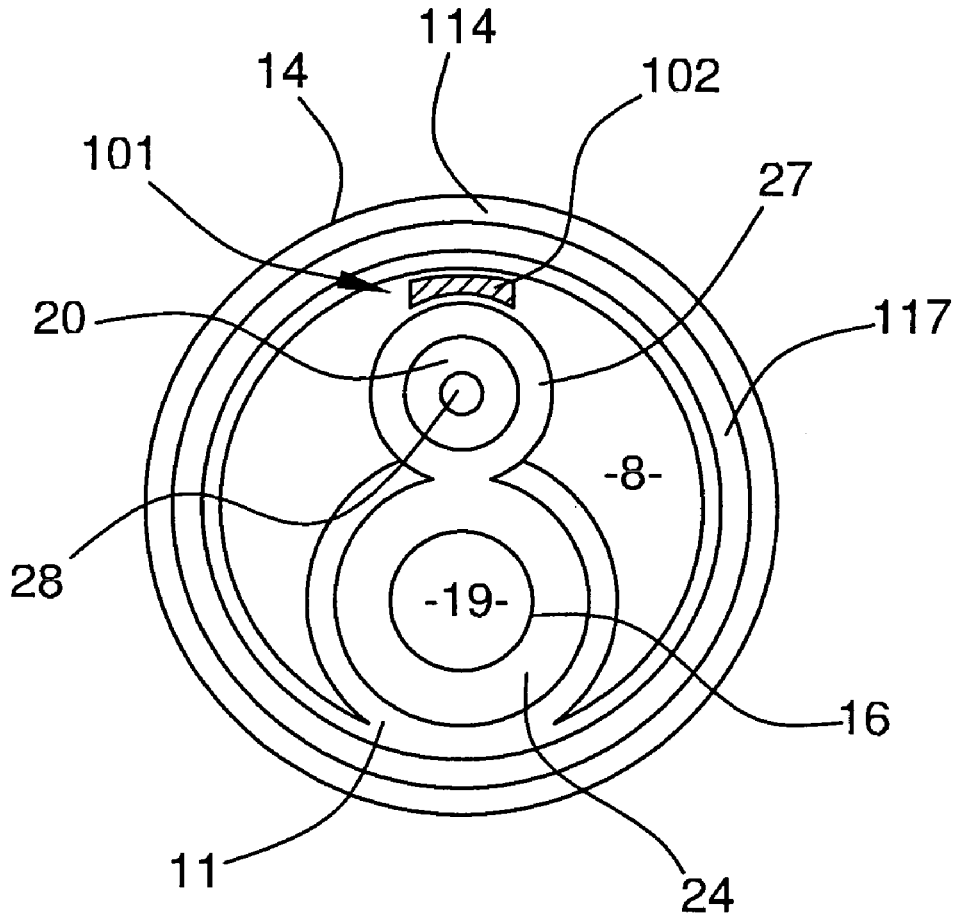
FIG. 3 is an end view from the opposite end of the inductor in FIG. 1 showing a locator pin in cross section.

The reagent injecting liquid aerator 5 of this invention may be used as a venturi injector nozzle with the apparatus disclosed in my U.S. Patents numbered U.S. Pat. No. 6,074,562 and 6,080,306 to remove hydrogen sulfide from potable water by the methods disclosed in those patents. This aerator can also be used to keep hydropneumatic water pump storage tanks loaded with an air cushion. The invention can also be used to aerate and inject reactant or reagent chemical solutions or gasses and to recycle reverse osmosis aqueous condensate back into a stream of water being treated. It is intended that filtered and unfiltered atmospheric air be included in the definitions of reagent and reactant as used herein.

The aerator injector 5 includes an integral, generally circular, essentially solid block housing 10. The block-like interior 11 of the housing is solid except that cavities 6, in accord with common molding industry practice, may be needed in various locations to compensate for shrinkage or distortion when molten plastic is injected into a mold, or when metal alloys are cast in sand mold. Also, shallow, crescent shaped cavities 7 and 8 at each end may be used to provide working clearances, and holes and vents may be provided for gages and other attachments. Housing 10 has an exterior wall or surface 12, an unaerated water inlet end 13 and an opposite aerated water outlet end 14. A first circular conduit 16 for unaerated water or water without a reagent extends through the solid interior 11 of the housing from its inlet end 13 to its outlet end 14. A second circular conduit 17 for water that is entrained with air and/or an other reagent also extends through the solid housing interior 11 from inlet end 13 to outlet end 14. The first and second conduits 16 and 17 are separated from each other by the solid interior 11 of the housing so that they provide distinct, separated water flow channels 19 and 20 through the interior of housing 10. The water passing through housing 10 flows in the same general direction through the separated channels 19 and 20. First conduit 16 has a first water inlet port 22 at the inlet end 13 of the housing and a discharge port 23 for aerated water or water with a reactant at the outlet end 14 of the housing. A first valve seat 24 in first conduit 16 is located between the first water inlet port 22 and the water discharge port 23. Second conduit 17 has a second water inlet port 25 at the housing inlet end 13 and a discharge port 27 for aerated water or water with a reactant at the outlet end 14.

The second conduit 17 has a constricted portion 28 between The second water inlet port 25 and the aerated water discharge port 27. The constriction 28 provides a venturi effect inside of channel 20. An externally threaded hole or aperture 30 through the housing exterior wall 12 is located at constriction 28. The suction created by the venturi may draw atmospheric air into the second conduit 17 and entrain the air into the water passing through the second conduit when the valve 31 in T-shaped pipe fitting 32 is open. The suction from the venturi may also be used to draw in a reactant solution for increasing ph, such as sodium hydroxide, or a disinfectant, such as sodium hypochlorite, or a gas such as oxygen, instead of or in addition to atmospheric air, into the water passing through channel 20 when the valve 33 is open.

The housing 10 may have tapped or threaded holes at predetermined locations for attachment of conventional accessories, such as pressure gages and metering valves, that are not a part of this invention. For example, a pressure gage may be threaded into to tapped hole 35 that is connected to a inlet pressure vent opening 36, a needle valve threaded into tapped hole 37, and a poppet valve 38 attached to hole 30. The outlet end 14 of housing 10 should have a plurality of locator openings or recesses that can be used to properly align flow channels and valves that may be in various end caps that are attached to the housing. Projections on the end caps will protrude beyond the end caps and extend into the locator openings.

Figure 4:
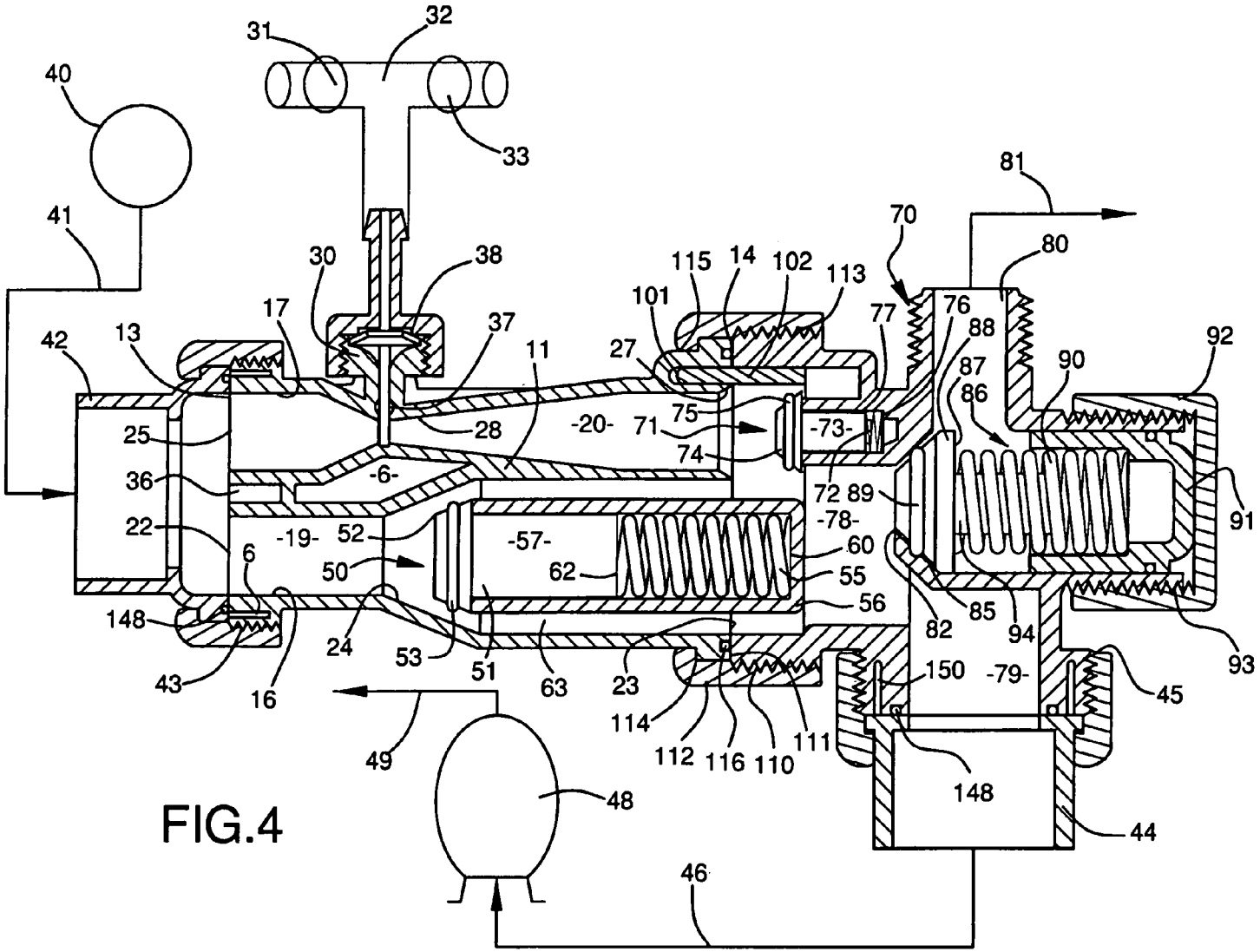
FIG. 4 is a schematic partially cross sectional side view of an embodiment of apparatus using the inductor of FIG. 1
Figure 5:
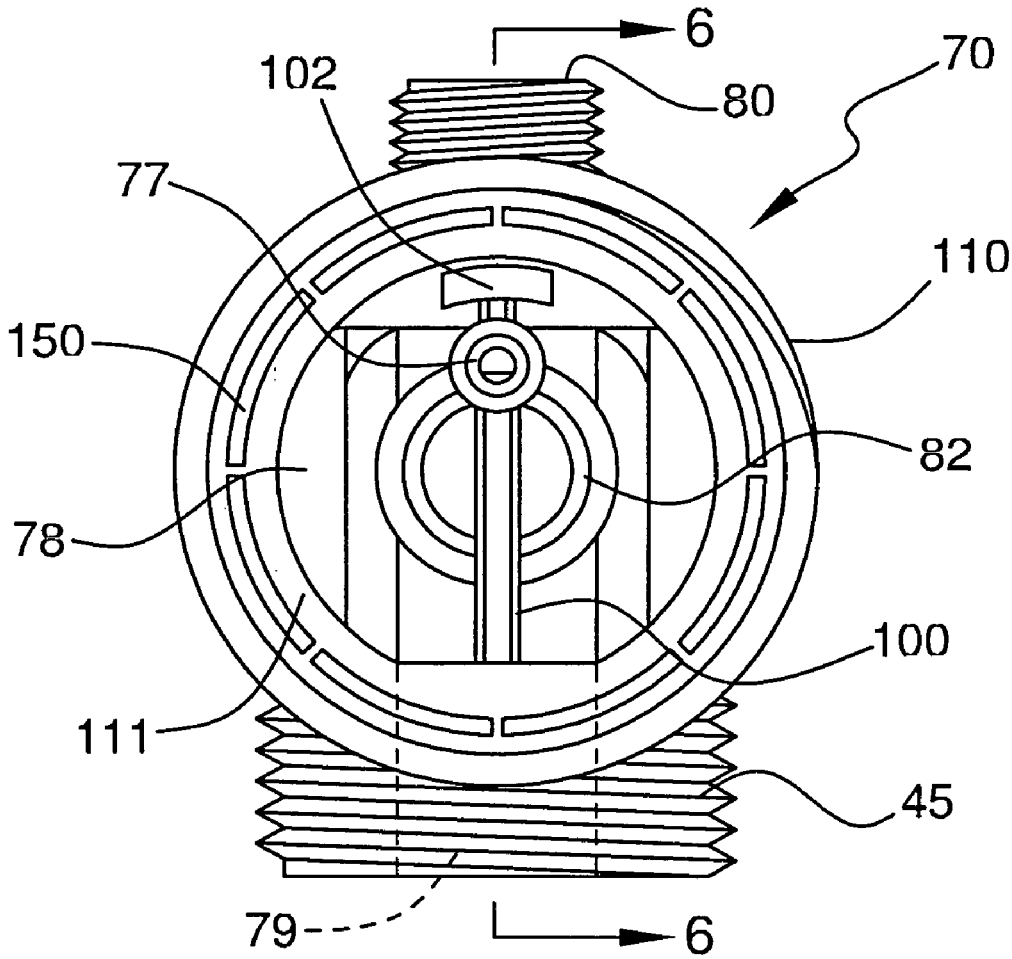
FIG. 5 is an end view of the end cap of the apparatus in FIG. 4.
Figure 6:
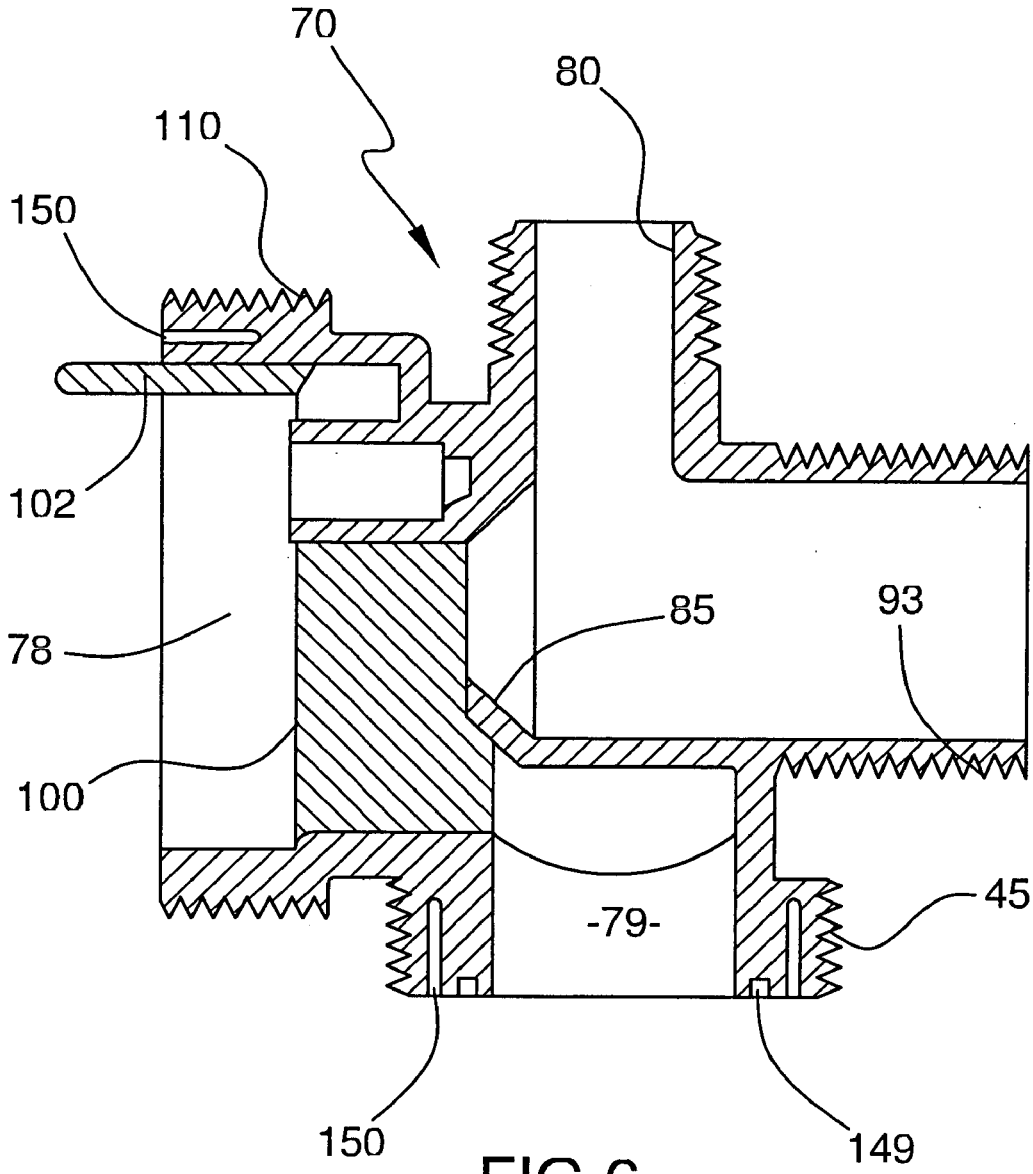
FIG. 6 is a cross sectional view taken along the line 6—6 in FIG. 5.

FIGS. 4 and 5 show an embodiment of the invention that may be used in a system that removes hydrogen sulfide from potable water, or in a system that keeps hydro-pneumatic water pump storage tanks loaded with an air cushion. A source of pressurized potable water 40 may be connected to inlet end 13 of housing 10 through a line 41 to a fitting 42 that is threaded on to external threads 43 that surround end 13. Outlet end 14 may be connected through a fitting 44 that is threaded on to external threads 45 to a line 46 to a pressurized tank 48 that is used to treat potable as described in my aforementioned patents, or the tank 48 may be used to store water under an air cushion. Water may pass out of tank 48 through a service line 49.

A removable first valve closure assembly 50 is located in the flow channel 19. It has a first poppet valve closure member 51 that has a head 52 encircled by an O-ring 53 and is sized to mate with the first valve seat 24. A coil compression first spring 55 urges closure member 51 toward seat 24 in a direction opposite to the flow direction of water in the first conduit 16. A removable, hollow, cylindrical first valve positioner or capsule 56 containing the valve member 51 and spring 55 locates the spring and valve closure member in the center of the first conduit. The closure member 51 has a cylindrical stem 57 that is inserted into the positioner 56. The head 52 of the member 51 is located outside of the positioner. One end of the spring 55 bears against an end 60 of the positioner, and the opposite end of the spring bears against the end 62 of the member 51. The first positioner has a diameter less than that of the first conduit 16 so that liquid in the conduit can flow around the first positioner. Two pair of diametrically opposed, longitudinally extending, radial fins 63 on the outside of positioner 56 hold the positioner in the center of the conduit 16. The fins 63 ensure that the positioner will remain centered in the conduit 16 even though variable hydraulic and mechanical forces acting on the positioner may cause the positioner to shift or rotate.

A removable flow control end cap 70 into which aerated and unaerated liquid may be directed is attached to end 14 of the housing. In the end cap 70, a removable second poppet valve closure assembly 71 for the second valve seat 27 includes a second valve closure member 73 that has a head 74 encircled by an O-ring 75 and is sized to mate with the seat 27. A coil second spring 76 in a cylindrical cavity 77 in the end cap urges valve closure member 73 toward the second seat in a direction opposite to the direction of aerated water flow through the second conduit 20. A stem 72 extends from the bottom of member 73 into spring 76. The second valve closure assembly end cap 70 has a collection conduit or chamber 78 for hydraulically combining the water that has flowed through the first and second conduits 19 and 20 and a discharge conduit or chamber 79 connected to the collection chamber. A pressure relief outlet 80 is connected by a line 81 to a suitable drain or recycling line. A pressure relief port 82 between the collection chamber 78 outlet 80 has a third valve seat 85. A removable third valve closure assembly 86 has a third poppet valve closure member 87 that has a head 88 encircled by an O-ring 89 is sized to mate with port 82. A coil third spring 90 urges the valve closure member 87 toward the valve seat 85. A removable hollow cylindrical second positioner 91 contains the member 87 and spring 90 and holds spring 90 and closure member 87 within the end cap. A stem 94 from valve closure member 87 extends into the center of spring 90. A threaded cap 92 screws on to external threads 93 on end cap 70 so as to removably hold the third valve closure assembly in the end cap.

An relatively thin, centrally located abutment 100 extends into collection chamber 78 for holding the first positioner 56 in place in the first conduit. The abutment 100 may completely span the chamber 78 as shown or may only extend part way across the chamber. After the end cap 70 has been attached to the housing 10, the abutment bears against a central diameter of the end 60 of the positioner capsule 56 and holds the positioner securely in place in the conduit 19 against the flow of liquid in the conduit, as shown on FIG. 10. Liquid in chamber 78 flows past both sides of abutment 100.

A portion of cavity 8 defines a curved end cap locator opening or recess 101 at outlet end 14. A curved locator pin 102 that has a complementary shape that fits into the opening 101 protrudes beyond the end cap valve closure assembly at a predetermined location. Insertion of the locator pin 102 into the locator opening 101 positions head 74 of second valve closure member 73 in the second valve seat 27. The locator pin 102 also ensures that the abutment 100 will be positioned against the end 60 of the first valve closure member in the collection conduit 79.

Flow control end cap 70 has external threads 110 circumscribing one of its ends 111. A rotatable ring 112 encircling the outlet end 14 of the housing may be used to removably attach the end cap. Ring 112 has internal threads 113 that mate with end cap threads 110. The housing 10 has an outwardly projecting peripheral rim 114. Ring 112 has an inwardly projecting circumferential ledge 115 that bears against rim 114 so that rotation of the ring draws ends of the end cap toward the outlet end 14 of the housing and compresses a gasket such as O-ring 116 in a groove 117 between the mating end cap end 111 and outlet end 14. Engagement of threads 110 and 113 and rotation of ring 112 removably attaches the second valve assembly end cap to the housing 10.

The strength or value of the springs 55, 76 and 90 is predetermined to enable the valve closure members 50, 71 and 86 to open and close the conduits 19 and 20 and pressure relief outlet 80 at the design pressures and flow rates of the system. The aerator 5 can be adjusted to changes in the pressure or volume of water flowing into or out of the system, or when the system requires more or less aeration of the water flow. The aerator is adjusted by unscrewing the ring 112 and separating the end cap 70 from the housing 10. Then one or more of the springs 55, 76 or 90 can be changed to a spring or springs of different strength to enable the aerator to provide the adjusted aeration required.

Figure 7:
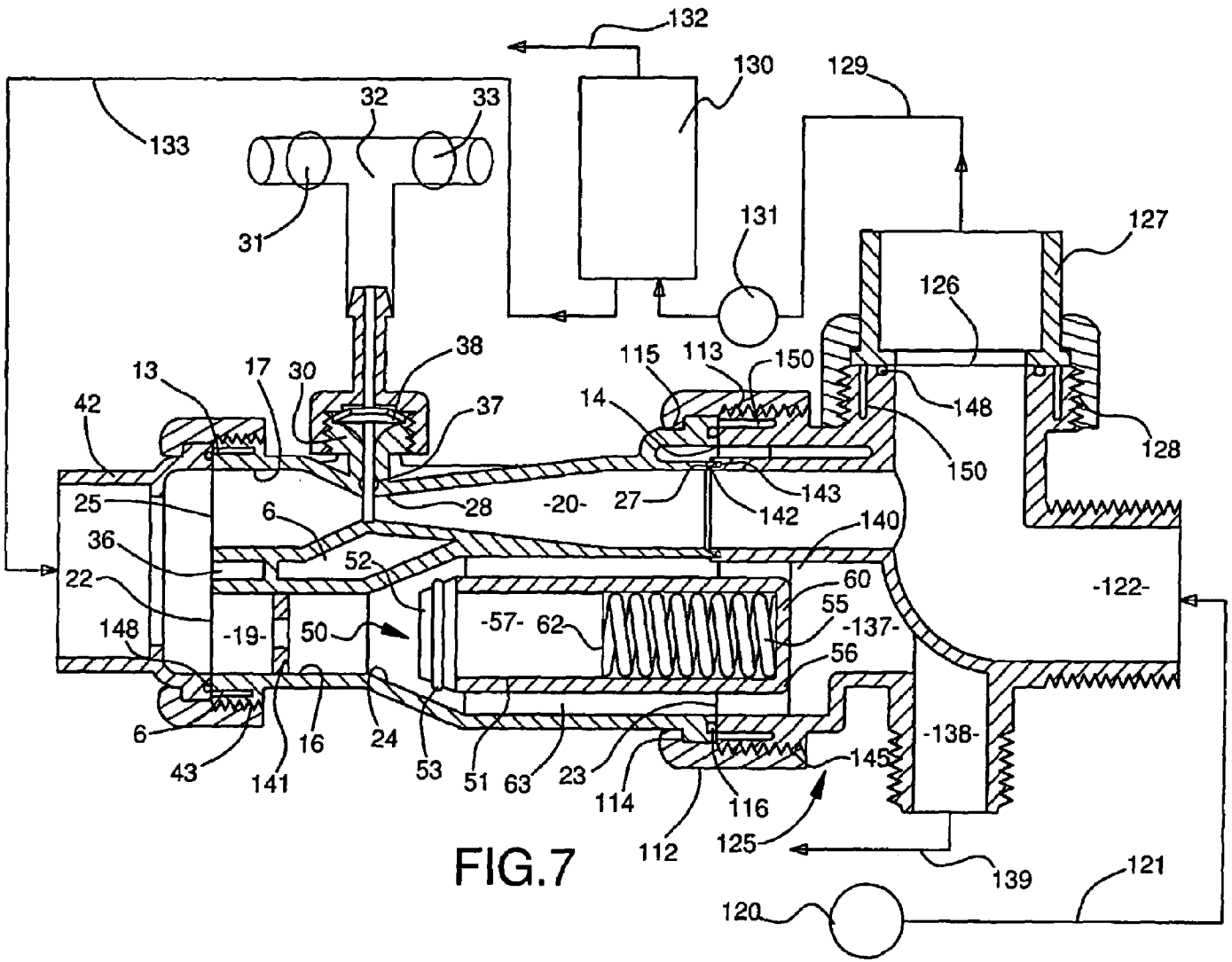
FIG. 7 is a schematic partially cross sectional side view of another embodiment of apparatus using the inductor of FIG. 1
Figure 8:
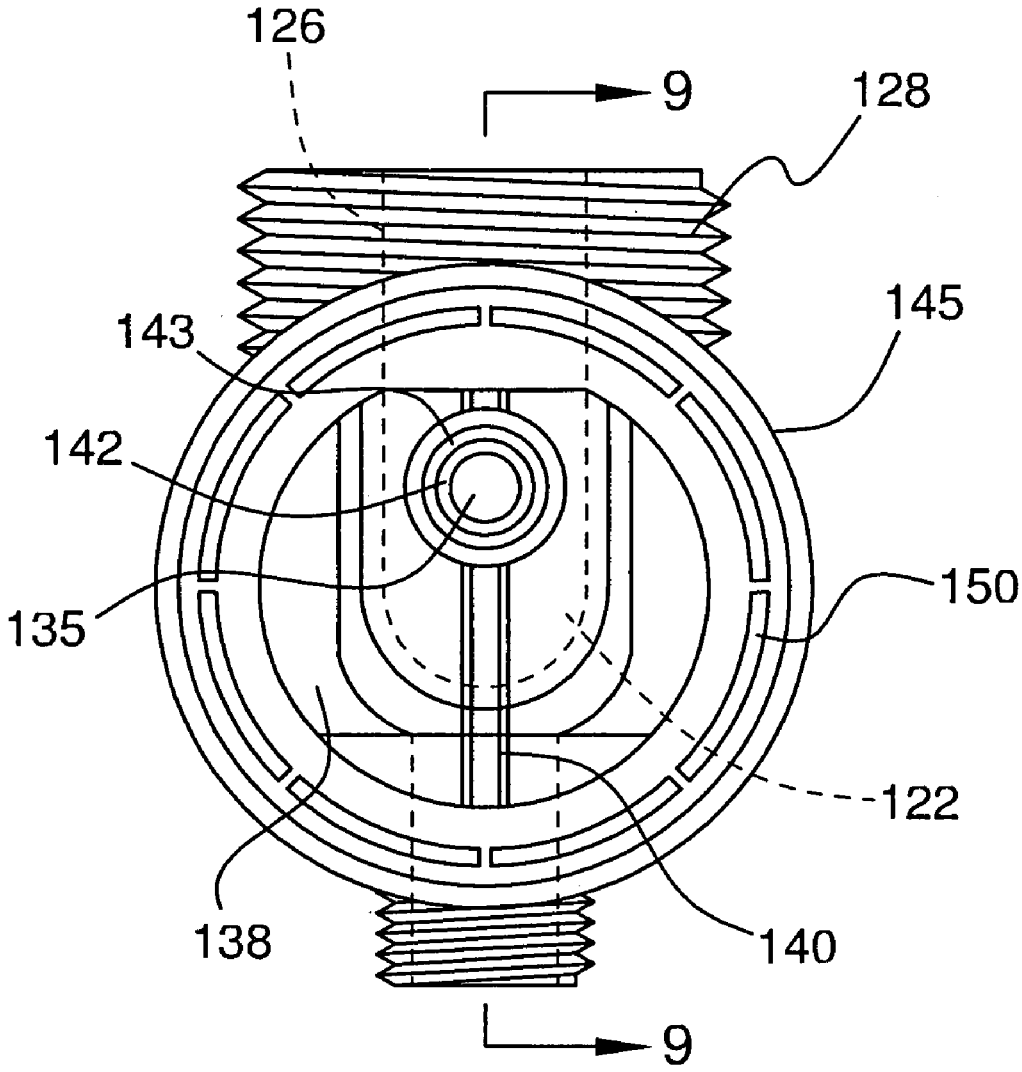
FIG. 8 is an end view of the end cap of the apparatus in FIG. 7.
Figure 9:
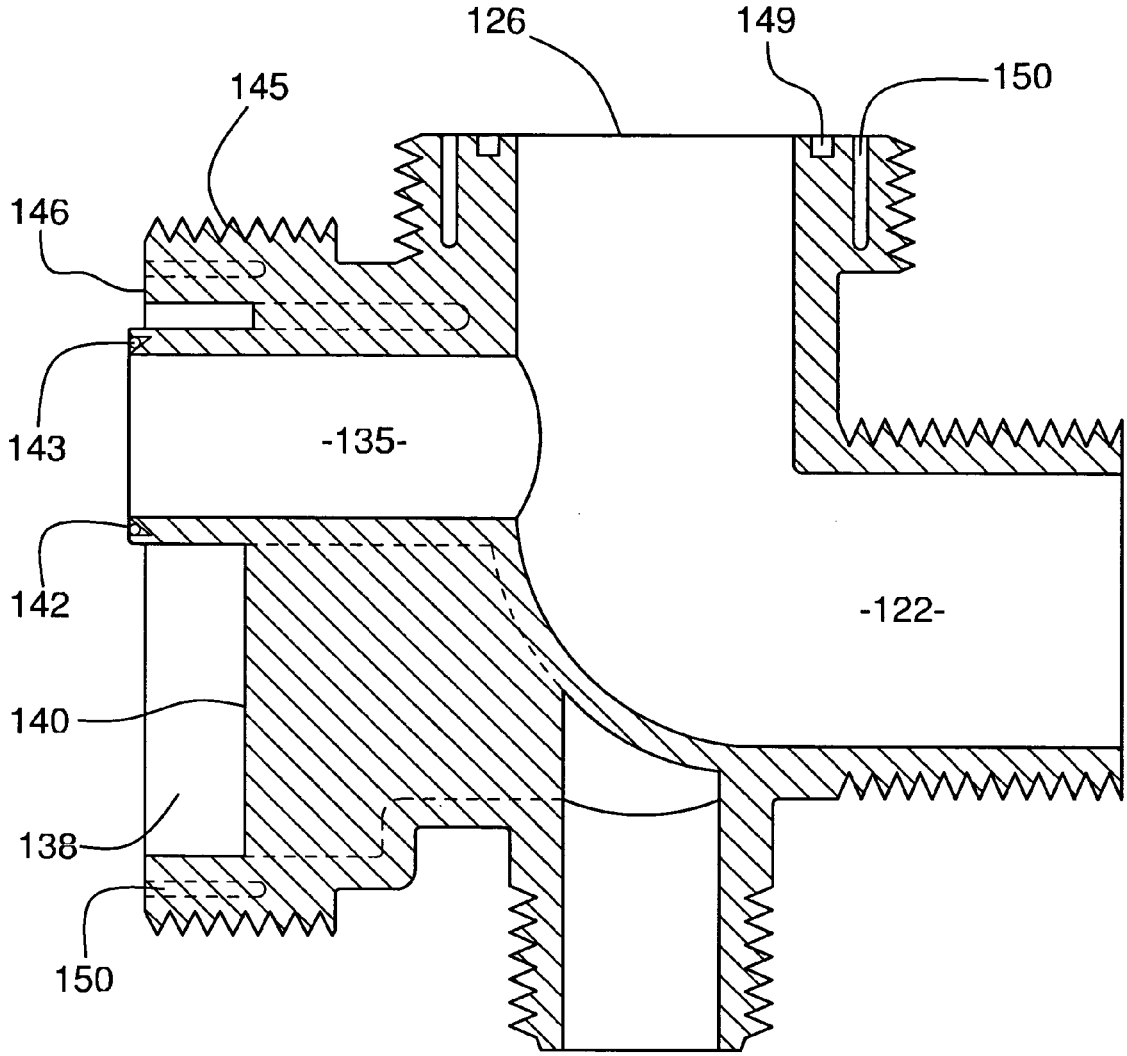
FIG. 9 is a cross sectional view taken along the line 9—9 in FIG. 8.

FIGS. 7–9 show an embodiment of the invention that may be used in a system that treats potable water by reverse osmosis or similar form of membrane water treatment. A source of pressurized potable water 120 may be connected through a line 121 to an untreated water inlet conduit 122 of a removable flow control end cap 125. An outlet port 126 may be connected through a fitting 127 that is threaded on to external threads 128 to a line 129 to a reverse osmosis unit 130 pressurized by a pump 131. Treated water passes out of the unit 130 through a service line 132, and aqueous condensate concentrate leaves through a recycle line 133. The condensate recycle line 133 may be connected to inlet end 13 of housing 10 through a fitting 42 that is threaded on to external threads 43 that surround end 13. The structure and operation of the parts of the housing 10 and the first valve closure assembly 50 are identical to those described above, so the same reference numbers will be used to identify identical parts. Air may be injected into the condensate when valve 31 is open. Reactant solutions and/or gasses may be added when valve 33 is open.

End cap 125 has a conduit 135 for aerated aqueous condensate that is hydraulically connected to discharge port 27 of second conduit 20. Conduit 135 hydraulically connects port 27 to inlet conduit 122. The pump 131 increases the pressure in line 133 above that in conduit 122 so the condensate in line 133 can flow through conduits 20 and 135 into conduit 122. A waste chamber 137 hydraulically connects discharge port 23 of first conduit 19 through a waste drain conduit 138 to a waste drain outlet line 139 for disposal of excess condensate that can not be recycled.

Figure 10:
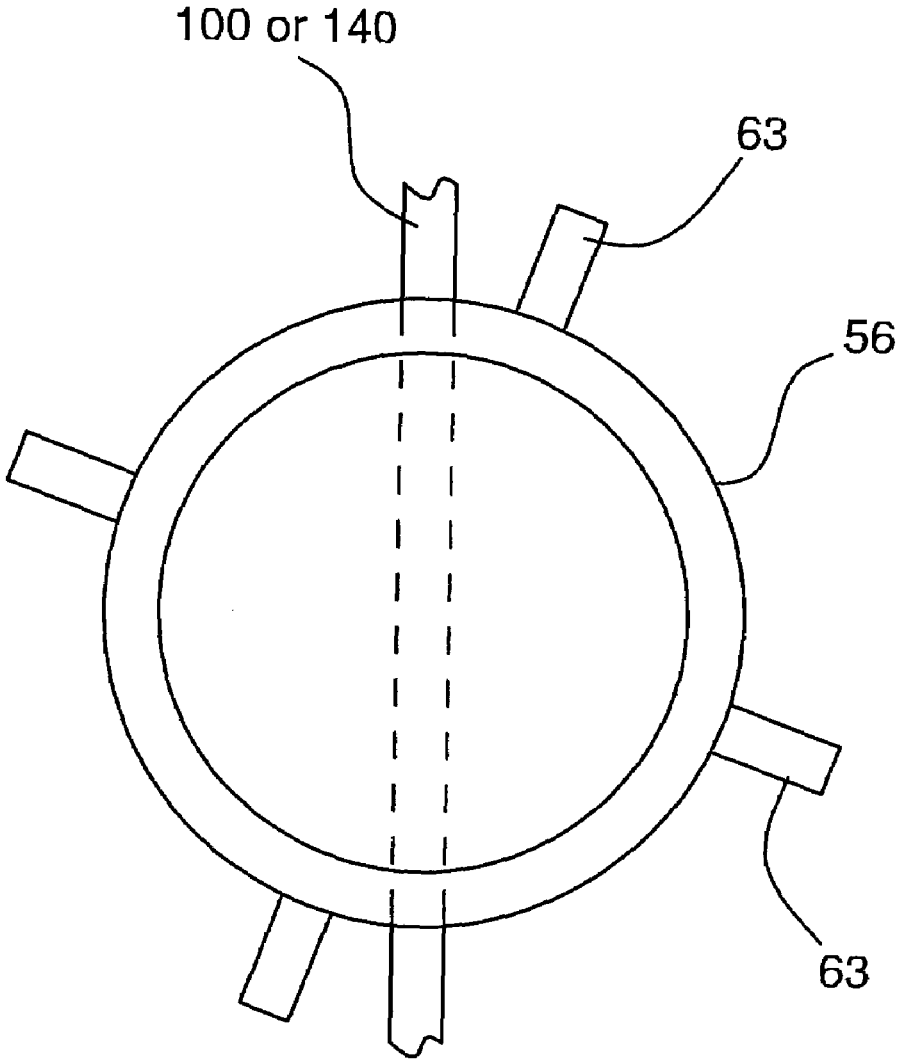
FIG. 10 is an open end view of a positioner capsule and partial view of an abutment in accord with this invention.

An relatively thin, centrally located abutment 140 extends into conduit 137 for holding the first positioner 51 in place in the first conduit. The abutment 140 may completely span the conduit 138 as shown or may only extend part way across the conduit. After the end cap 125 has been attached to the housing 10, the abutment 140 bears against a central diameter of the end 60 of the positioner capsule 56 and holds the positioner securely in place in the conduit 19 against the flow of condensate in the conduit, as shown in FIG. 10. Liquid in conduit 138 flows past both sides of abutment 140. A flow control washer 141 may be located in conduit 19 between inlet 22 and conduit 138.

A hollow, circular end cap locator projection 142 extends beyond end cap 125 into aerated liquid discharge port 27, which serves as the locator opening in this embodiment. An O-ring 143 around projection 142 seals against the side wall of the port 27. Projection 142 aligns port 27 and conduit 135 with outlet conduit 126 and places the abutment 140 into contact with the end 60 of first valve positioner to hold the valve positioner in first conduit 19 against the flow of concentrate in the first conduit. The fact that projection 142 is hollow enables the hydraulic connection between channel 20 and conduit 135.

Flow control end cap 125 has external threads 145 circumscribing one of its ends 146. The rotatable ring 112 encircling the outlet end 14 of the housing 10 may also be used to removably attach end cap 125. Ring 112 has internal threads 113 that mate with end cap threads 145. The housing 10 has an outwardly projecting peripheral rim 114. Ring 112 has an inwardly projecting circumferential ledge 115 that bears against rim 114 so that rotation of the ring draws ends of the end cap toward the outlet end 14 of the housing and compresses a gasket such as O-ring 116 in a groove 117 between end cap end 146 and outlet end 14. Engagement of threads 145 and 113 and rotation of ring 112 removably attaches the end cap to the housing 10.

The strength or value of the spring 55 and the size of the hole in the washer 141 are predetermined to enable the valve closure members 50 to open and close the conduits 19 at the design pressures and flow rates of the system. The aerator 10 can be adjusted to changes in the pressure or volume of potable water entering inlet 122 or of aqueous condensate flowing from unit 130, or when the system requires more or less aeration of the condensate flow. The aerator is adjusted by unscrewing the ring 112 and separating the end cap 125 from the housing 10. Then the spring 55 may be changed to a spring of different strength to enable the aerator to provide the adjusted aeration required. Another adjustment may be made by unscrewing fitting 42 and changing the size of washer 141.

The housing 10 and end caps 70 and 125 may be cast from any plastic, such as PVC or ABS, or from lead-free metal alloys, such as brass, bronze or stainless steel that are usable at elevated pressures and temperatures in potable water service. Other gaskets such as O-rings 148 in grooves 149 may be used where indicated to prevent leakage. End caps 70 and 125 also may have cavities 150, in accord with common molding industry practice, in various locations to compensate for shrinkage or distortion when molten plastic is injected into a mold.

Figure 11:
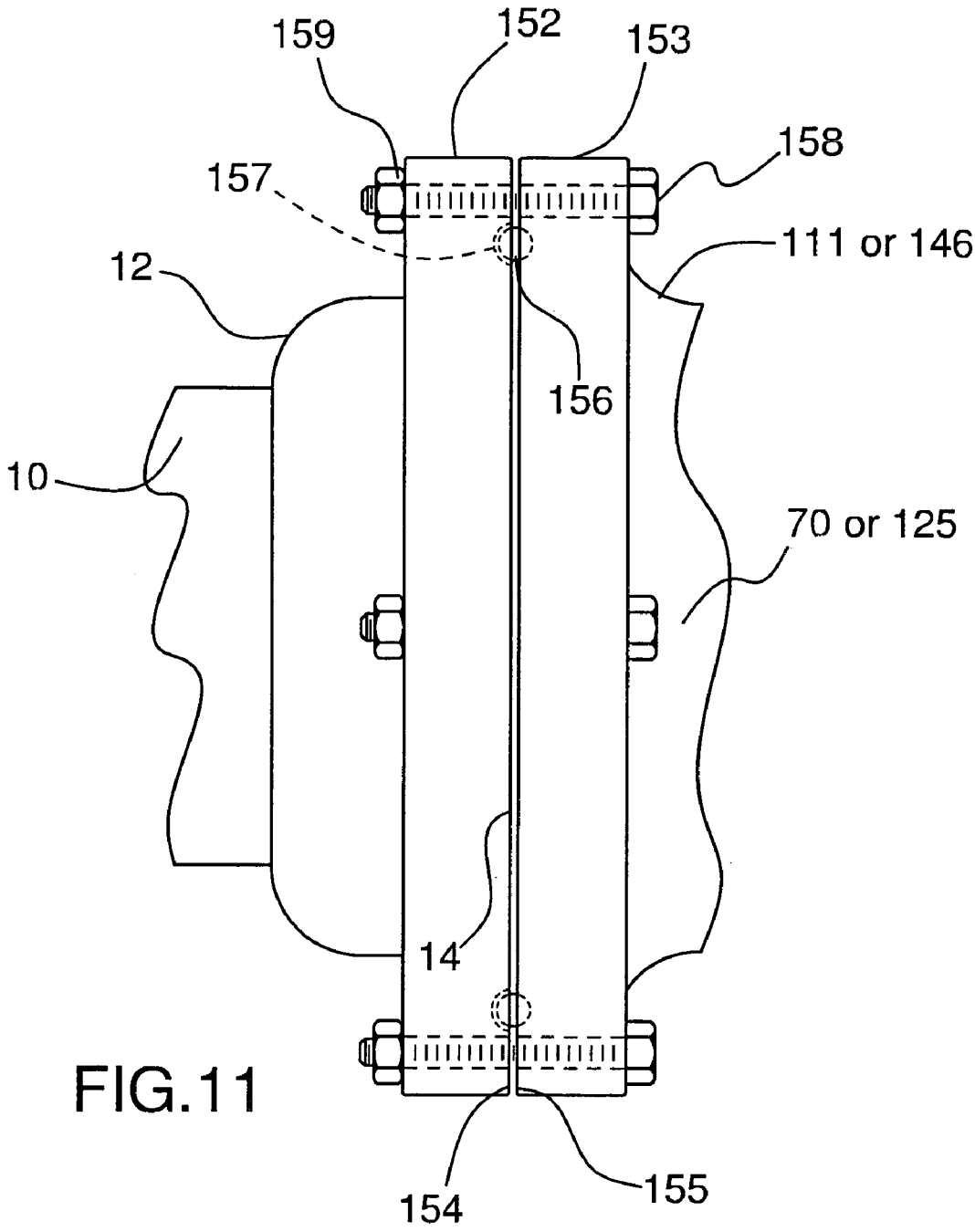
FIG. 11 is a schematic partial side view of another embodiment of the invention.

FIG. 11 shows another embodiment of the invention in which the means for removably attaching an end cap 70 or 125 may include a circular first peripheral rim 152 on the outlet end 14 of the housing 10. Rim 152 circumscribes the housing and extends beyond the exterior surface 12 of the housing. The end cap 70 or 125 has a circular second peripheral rim 153 at its mating end 111 or 146. Rim 153 circumscribes its end cap and extends beyond the outer surface of the end cap. The rims 152 and 153 have flat abutting faces 154 and 155. An O-ring gasket 156 in lodged in a groove 157 between the abutting faces. A plurality of threaded fasteners such a headed bolts 158 with nuts 159 secure the rims 152 and 153 together so as to compress the O-ring 156 therebetween.

While the present invention has been described with reference to particular embodiments, it is not intended to illustrate or describe all of the equivalent forms or ramifications thereof. Also, the words used are words of description rather than limitation, and various changes may be made without departing from the spirit or scope of the invention disclosed herein. It is intended that the appended claims cover all such changes as fall within the true spirit and scope of the invention.

I claim:

1. A reagent injector for treating a liquid, comprising:

A. an integral, solid housing having an exterior wall and a liquid inlet end and a liquid outlet end, a first conduit for liquid extending through a solid interior of said housing from its inlet end to its outlet end, a second conduit for liquid that has been injected with reagent extending through the solid interior of said housing from its inlet end to its outlet end, said first and second conduits being separated from each other in said solid housing so as to provide separated liquid flow channels through the interior of said housing with the liquid flowing in the same general direction through the separated channels, said first conduit having a first liquid inlet port at said inlet end of said housing and a discharge port for liquid without said reagent at said outlet end of said housing, a first valve seat in said first conduit between said first liquid inlet port and said discharge port for liquid without said reagent, said second conduit having a second liquid inlet port at said inlet end of said housing and a discharge port for liquid injected with reagent at said outlet end of said housing, said second conduit having a constricted portion between said second liquid inlet port and said discharge port for liquid injected with reagent that defines a venturi thereinside, an aperture through said exterior wall of said housing located at said constricted portion for entry of said reagent drawn in by said venturi that is entrained into the liquid passing through said second conduit, and there being a locator recess in said outlet end of said of said housing;

B. a removable first valve closure assembly comprising a first valve closure member sized to mate with said first valve seat and a first spring urging said first valve closure member toward said first valve seat in a direction opposite to the flow direction of liquid in said first conduit, a removable first valve positioner containing said first valve closure member and said first spring that locates said first spring and said first valve closure member in said first conduit;

C. a removable flow control end cap having a plurality of outlet conduits to which liquid flowing out of said liquid discharge port for liquid injected with reagent and said discharge port for liquid without said reagent are directed, an abutment extending into one of said outlet conduits, and an end cap locator protruding beyond said end cap at a predetermined location, said end cap locator being inserted into said locator recess in said outlet end of said housing so as to align said liquid discharge port for liquid injected with reagent and said liquid discharge port for liquid without said reagent with predetermined outlet conduits in said end cap and to place said abutment into contact with said first valve positioner to hold said first valve positioner in said first conduit against the flow of liquid in said first conduit; and D. means for removably attaching said flow control end cap to said outlet end of said housing.

2. The reagent injector for treating a liquid defined in claim 1, further comprising, said flow control end cap having external threads circumscribing one of its ends, said means for removably attaching said flow control end cap comprising a rotatable ring encircling said outlet end of said housing, said ring having internal threads that mate with said external threads on said end cap, a gasket between said one end of said end cap and said outlet end of said housing, and engagement of said threads and rotation of said ring removably attaching said second valve assembly to said housing.

3. The reagent injector for treating a liquid defined in claim 2, further comprising, an outwardly projecting peripheral rim on said housing, an inwardly projecting circumferential ledge on said ring, said ledge bearing against said rim so that rotation of said ring draws said one end of said end cap toward said outlet end of said housing and compresses said gasket therebetween.

4. The reagent injector for treating a liquid defined in claim 1, further comprising, said means for removably attaching said end cap comprising a circular first peripheral rim on said outlet end of said housing that circumscribes and extends beyond said housing, a circular second peripheral rim on said end cap that circumscribes and extends beyond said end cap, said first and second rims having flat abutting faces, a gasket between said abutting faces, and a plurality of threaded fasteners securing said rims together so as to compress said gasket therebetween.

5. The reagent injector for treating a liquid defined in claim 1, further comprising, said first positioner being a first hollow cylinder having a cylindrical center cavity, said first spring being a first coil compression spring located in said center cavity, said first valve closure member having a cylindrical stem inserted into said first positioner and a shoulder located outside of said first positioner, one end of said first coil spring bearing against an inside end of said first positioner, and an opposite end of said first coil spring bearing against an end of said first valve closure member inside of said first positioner, said first positioner having a diameter less than that of said first conduit, radial fins on said first positioner holding said first positioner in the center of said first conduit so that liquid in said first conduit can flow around said first positioner.

6. The reagent injector for treating a liquid defined in claim 1, further comprising, said first and second conduits being circular in cross section, said locator recess being curved and said protruding end cap locator having a curvature complimentary to the curvature of said locator recess, a second valve seat in said discharge port for liquid injected with reagent of said second conduit, said end cap comprising a removable second valve closure assembly for said second valve seat comprising a second valve closure member sized to mate with said second valve seat, and a second spring urging said second valve closure member toward said second seat in a direction opposite to the direction of liquid flow through said second conduit, said end cap having a collection conduit for combining the liquid that has flowed through said first and second conduits, a pressure relief outlet in said end cap, a pressure relief port between said collection conduit and said pressure relief outlet, a third valve seat in said pressure relief port, a removable third valve closure assembly within said end cap comprising a third valve closure member sized to mate with said pressure relief port, a third spring urging said third valve closure member toward said third valve seat, and a removable second positioner containing said third valve closure member and said third spring that holds said third spring and said third valve closure member within said end cap, and means for removably attaching said third valve closure assembly to said end cap.

7. The reagent injector for treating a liquid defined in claim 1, wherein said end cap comprises an untreated water supply inlet conduit, a liquid conduit hydraulically connecting said discharge port of said second conduit to said water supply inlet conduit, a drain conduit hydraulically connected to said discharge port for liquid without reagent of said first conduit.

8. A water aerator, comprising:

A. an integral, housing having an exterior wall and an unaerated water inlet end and an aerated water outlet end, a first conduit for unaerated water extending through the interior of said housing from its inlet end to its outlet end, a second conduit for water that is entrained with air extending through the interior of said housing from its inlet end to its outlet end, said first conduit having a first water inlet port and an unaerated water discharge port, a first valve seat in said first conduit, said second conduit having a second water inlet port and an aerated water discharge port, said second conduit having a constricted portion between said second water inlet port and said aerated water discharge port that defines a venturi thereinside, an aperture through said exterior wall of said housing located at said constricted portion for entry of atmospheric air that is entrained into the water passing through said second conduit, a second valve seat in said aerated water discharge port, B. a first valve closure member in said housing that is sized to mate with said first valve seat and a first spring urging said first valve closure member toward said first valve seat;

C. a removable end cap having a valve closure assembly for said second valve seat comprising a second valve closure member sized to mate with said second valve seat, a second spring urging said second valve closure member toward said second seat in a direction opposite to the aerated water flow through said second conduit, said end cap having a collection conduit for combining the water that has flowed through said first and second conduits, a pressure relief outlet in said end cap, a pressure relief port between said collection conduit and said pressure relief outlet, a third valve seat in said pressure relief port, a third valve closure member sized to mate with said pressure relief port in said end cap, a third spring urging said third valve closure member toward said third valve seat; and D. means for removably attaching said end cap to said outlet end of said housing.

9. The water aerator defined in claim 8, further comprising, means for removably attaching said third valve closure assembly to said second valve closure assembly, and an abutment extending into said collection conduit holding said first valve closure member in said first conduit.

10. The water aerator defined in claim 9, further comprising, a locator pin protruding beyond said end cap at a predetermined location, there being a locator opening in said housing at its outlet end, so that insertion of said locator pin into said opening positions said second valve closure member in said second valve seat, and positions said abutment in said collection conduit against an end of said first valve closure member.

11. The water aerator defined in claim 8, further comprising, a removable hollow cylindrical first positioner having a cylindrical first center cavity, said first spring being a first coil compression spring located in said first center cavity, said first valve closure member having a cylindrical stem inserted into said first positioner and a shoulder located outside of said first positioner, one end of said first coil spring bearing against an inside end of said first positioner, and an opposite end of said first coil spring bearing against an end of said stem, said first positioner having a diameter less than that of said first conduit so that liquid in said first conduit can flow around said first positioner, a removable hollow cylindrical second positioner having a cylindrical second center cavity, said third spring being a third coil compression spring located in said second center cavity, said third valve closure member having a cylindrical stem inserted into said third coil spring and a shoulder located outside of said second positioner, one end of said third coil spring bearing against an inside end of said second positioner, and an opposite end of said third coil spring bearing against said shoulder of said third valve closure member.

12. A water aerator, comprising:

A. an integral, housing having an exterior wall and a water inlet end and an aerated water outlet end, a first conduit for unaerated water extending through the interior of said housing from its inlet end to its outlet end, a second conduit for water that is entrained with air extending through the interior of said housing from its inlet end to its outlet end, said first and second conduits being separated from each other in said housing so as to provide separated water flow channels through the interior of said housing with the water flowing in the same general direction through the separated channels, said first conduit having a first water inlet port at said inlet end of said housing and an unaerated water discharge port at said outlet end of said housing, a first valve seat in said first conduit between said first water inlet port and said unaerated water discharge port, said second conduit having a second water inlet port at said inlet end of said housing and an aerated water discharge port at said outlet end of said housing, said second conduit having a constricted portion between said second water inlet port and said aerated water discharge port that defines a venturi there inside, an aperture through said exterior wall of said housing located at said constricted portion for entry of atmospheric air that is entrained into the water passing through said second conduit, a second valve seat in said aerated water discharge port, B. a first valve closure member in said first conduit that is sized to mate with said first valve seat and a first spring urging said first valve closure member toward said first valve seat in a direction opposite to the flow direction of water in said first conduit;

C. a removable end cap having a valve closure assembly for said second valve seat comprising a second valve closure member sized to mate with said second valve seat, a second spring urging said second valve closure member toward said second seat in a direction opposite to the direction of aerated water flow through said second conduit, said second valve closure assembly having a collection conduit for combining the water that has flowed through said first and second conduits, a pressure relief outlet in said valve closure assembly, a pressure relief port between said collection conduit and said pressure relief outlet, a third valve seat in said pressure relief port, a third valve closure member sized to mate with said pressure relief port, a third spring urging said third valve closure member toward said third valve seat; and D. means for removably attaching said end cap to said outlet end of said housing.

13. The water aerator defined in claim 12, further comprising, means for removably attaching said third valve closure member to said end cap, and an abutment extending into said collection conduit holding said first valve closure member in said first conduit.

14. The water aerator defined in claim 13, further comprising, a locator pin protruding beyond said end cap at a predetermined location, there being a locator opening in said housing at its outlet end, so that insertion of said locator pin into said opening positions said second valve closure member in said second valve seat, and positions said abutment in said collection conduit against an end of said first valve closure member.

15. The water aerator defined in claim 12, further comprising, a removable hollow cylindrical first valve positioner having a cylindrical first center cavity, said first spring being a first coil compression spring located in said first center cavity, said first valve closure member having a cylindrical stem inserted into said first positioner and a shoulder located outside of said first positioner, one end of said first coil spring bearing against an inside end of said first valve positioner, and an opposite end of said first coil spring bearing against said stem of said first valve closure member, a removable hollow cylindrical second valve positioner having a cylindrical second center cavity, said third spring being a third coil compression spring located in said second center cavity, said third valve closure member having a cylindrical stem inserted into said third coil spring and a shoulder located outside of said second positioner, one end of said third coil spring bearing against an inside end of said second positioner, and an opposite end of said third coil spring bearing against said shoulder of said third valve closure member.

16. An adjustable potable water aerator, comprising:

A. an integral, housing having an exterior wall and a water inlet end and an aerated water outlet end, a first conduit for unaerated water extending through the interior of said housing from its inlet end to its outlet end, a second conduit for water that is entrained with air extending through the interior of said housing from its inlet end to its outlet end, said first and second conduits being separated from each other inside of said housing so as to provide separated water flow channels through the interior of said housing with the water flowing in the same general direction through the separated channels, said first conduit having a first water inlet port at said inlet end of said housing and an unaerated water discharge port at said outlet end of said housing, a first valve seat in said first conduit between said first water inlet port and said unaerated water discharge port, said second conduit having a second water inlet port at said inlet end of said housing and an aerated water discharge port at said outlet end of said housing, said second conduit having a constricted portion between said second water inlet port and said aerated water discharge port that defines a venturi thereinside, an aperture through said exterior wall of said housing located at said constricted portion for entry of atmospheric air that is entrained into the water passing through said second conduit, a second valve seat in said aerated water discharge port, B. a removable first valve closure assembly comprising a first valve closure member sized to mate with said first valve seat and a first spring urging said first valve closure member toward said first valve seat in a direction opposite to the flow direction of water in said first conduit, a removable first positioner containing said first valve closure member and said first spring that locates said first spring and said first valve closure member in said first conduit;

C. a removable end cap having a second valve closure assembly for said second valve seat comprising a second valve closure member sized to mate with said second valve seat, a second spring urging said second valve closure member toward said second seat in a direction opposite to the direction of aerated water flow through said second conduit, said end cap having a collection conduit for combining the water that has flowed through said first and second conduits, a pressure relief outlet in said end cap, a pressure relief port between said collection conduit and said pressure relief outlet, a third valve seat in said pressure relief port, a removable third valve closure assembly within said end cap comprising a third valve closure member sized to mate with said third valve seat, a third spring urging said third valve closure member toward said third valve seat, a removable second positioner containing said third valve closure member and said third spring that holds said third spring and said third valve closure member within end cap, means for removably attaching said third valve closure assembly to end cap, and means spanning said collection conduit holding said first removable positioner in said first conduit; and D. means for removably attaching said end cap to said outlet end of said housing.

17. The potable water aerator defined in claim 16, further comprising, a locator pin protruding beyond said second valve closure assembly at a predetermined location, there being a locator opening in said housing at its outlet end, so that insertion of said locator pin into said opening positions said second valve closure member in said second valve seat, and positions said abutment in said collection conduit against an end of said first positioner.

18. The potable water aerator defined in claim 16, further comprising, said first positioner having a cylindrical first center cavity, said first spring being a first coil compression spring located in said first center cavity, said first valve closure member having a cylindrical stem inserted into said first positioner and a shoulder located outside of said first positioner, one end of said first coil spring bearing against an inside end of said first positioner, and an opposite end of said first coil spring bearing against said stem of said first valve closure member, said second positioner having a cylindrical second center cavity, said third spring being a third coil compression spring located in said second center cavity, said third valve closure member having a cylindrical stem inserted into said third coil spring and a shoulder located outside of said second positioner, one end of said third coil spring bearing against an inside end of said second positioner, and an opposite end of said third coil spring bearing against said shoulder of said third valve closure member.

19. A aqueous concentrate aerator, comprising:

A. an integral, housing having an exterior wall and a aqueous concentrate inlet end and an aerated aqueous concentrate outlet end, a partition inside of said housing extending through said housing and dividing said housing into a first conduit for unaerated aqueous concentrate and a second conduit for aqueous concentrate that is entrained with air, said first and second conduits being separated from each other by said partition so as to provide separated aqueous concentrate flow channels through the interior of said housing with the aqueous concentrate flowing in the same general direction through the separated channels, said first conduit having a first aqueous concentrate inlet port at said inlet end of said housing and an unaerated aqueous concentrate discharge port at said outlet end of said housing, a back pressure drain valve seat in said first conduit between said first aqueous concentrate inlet port and said unaerated aqueous concentrate discharge port, said second conduit having a second aqueous concentrate inlet port at said inlet end of said housing and an aerated aqueous concentrate discharge port at said outlet end of said housing, said second conduit having a constricted portion between said second aqueous concentrate inlet port and said aerated aqueous concentrate discharge port that defines a venturi thereinside, an aperture through said exterior wall of said housing located at said constricted portion for entry of atmospheric air that is entrained into the aqueous concentrate passing through said second conduit;

B. a removable valve closure assembly comprising a valve closure member sized to mate with said back pressure drain valve seat and a spring urging said valve closure member toward said back pressure drain valve seat in a direction opposite to the flow direction of aqueous concentrate in said first conduit, a removable valve positioner containing said valve closure member and said spring that locates said spring and said valve closure member in said first conduit;

C. a removable flow control end cap comprising an untreated water supply inlet conduit, an aerated aqueous concentrate conduit hydraulically connecting said discharge port of said second conduit to said water supply inlet conduit, a drain conduit hydraulically connected to said discharge port of said first conduit; and D. means for removably attaching said removable flow control end cap to said outlet end of said housing.

20. The aqueous concentrate aerator defined in claim 19, further comprising: said removable flow control end cap comprising an abutment extending into said drain conduit that locates and holds said valve positioner in said first conduit by bearing against an exterior end of said valve positioner.

21. The aqueous concentrate aerator defined in claim 20, further comprising: a hollow end cap locator protruding beyond said flow control end cap at a predetermined location, there being a locator opening in said housing at its outlet end, so that insertion of said end cap locator into said opening positions said first valve closure member in said back pressure drain valve seat, and positions aerated aqueous concentrate conduit in alignment with said discharge port of said second conduit, and positions said abutment in said collection conduit against said end of said valve positioner.

22. The aqueous concentrate aerator defined in claim 19, further comprising: said removable valve positioner comprising a hollow cylinder having a cylindrical center cavity, said spring being a coil compression spring located in said center cavity, said valve closure member having a cylindrical stem inserted into said positioner and a shoulder located outside of said positioner, one end of said coil spring bearing against an inside end of said positioner, and an opposite end of said coil spring bearing against an end of said stem.

23. The aqueous concentrate aerator defined in claim 19, further comprising: flow control means between said aqueous concentrate inlet port of said first conduit and said drain conduit of said end cap.

* * * * *